US010093461B2

(12) United States Patent
Geiger et al.

(10) Patent No.: US 10,093,461 B2
(45) Date of Patent: Oct. 9, 2018

(54) TUBE WITH THROTTLE INSERT

(71) Applicant: Hoffmann Neopac AG, Thun (CH)

(72) Inventors: Andreas Geiger, Heimberg (CH); Andreas Eggenberg, Thun (CH)

(73) Assignee: Hoffmann Neopac AG, Thun (CH)

( * ) Notice: Subject to any disclaimer, the term of this patent is extended or adjusted under 35 U.S.C. 154(b) by 0 days.

(21) Appl. No.: 15/494,913

(22) Filed: Apr. 24, 2017

(65) Prior Publication Data

US 2017/0320641 A1 Nov. 9, 2017

(30) Foreign Application Priority Data

May 3, 2016 (CH) ..... 585/16

(51) Int. Cl.
*B65D 35/40* (2006.01)
*B65D 47/18* (2006.01)

(52) U.S. Cl.
CPC ..... *B65D 47/18* (2013.01); *B65D 35/40* (2013.01)

(58) Field of Classification Search
CPC ..... B65D 47/18; B65D 35/40; B65D 1/32; B65D 47/043; B65D 35/08; B65D 35/12; B65D 35/14; B65D 35/24
USPC ..... 222/547, 564, 212, 420, 421; 92/181 R, 92/181 P
See application file for complete search history.

(56) References Cited

U.S. PATENT DOCUMENTS 184,315 A * 11/1876 Armstrong ..... B65D 47/18 222/421
772,707 A * 10/1904 Elfstrand ..... B65D 47/18 222/421
1,760,773 A * 5/1930 Penney ..... B65D 35/24 206/216
2,249,832 A * 7/1941 Hubschman ..... B65D 47/18 222/420
2,598,403 A * 5/1952 Macey ..... B65D 47/283 215/309
2,657,836 A * 11/1953 Heinz ..... A47G 19/24 222/477
2,811,283 A * 10/1957 Bowen ..... B05B 11/04 222/109
3,102,651 A * 9/1963 Boese ..... B65D 47/18 215/307
3,302,833 A * 2/1967 Lcika ..... B65D 35/24 219/214

(Continued)

FOREIGN PATENT DOCUMENTS

WO 2004069679 8/2004
WO 2013075256 5/2013

*Primary Examiner* — Patrick M Buechner
(74) *Attorney, Agent, or Firm* — Volpe and Koenig, P.C.

(57) ABSTRACT

The tube (1) includes a connector (9) with a dispensing duct (13) which connects a dispensing opening (11) to a reservoir (3). For the dosed dispensing of a liquid from the reservoir (3) through the dispensing opening (11), a throttle insert (31) is inserted into a distal section (**9*b*) of the connector (9) and is connected in form-fitting fashion to the connector (9). The connection of the throttle insert (31) to the connector (9) is preferably realized by a radial pressing action. The throttle insert (31) is preferably of dome-like form and delimits at least one primary throttle duct (47) which forms in the dispensing duct a constriction which limits the volume flow of the liquid from the reservoir (3) to the dispensing opening (11**).

10 Claims, 2 Drawing Sheets

(56) References Cited

U.S. PATENT DOCUMENTS

| | | | | |
|---|---|---|---|---|
| 3,762,612 | A * | 10/1973 | Miller | B65D 47/122 222/479 |
| 6,536,631 | B1 * | 3/2003 | Nickels | B65D 47/2018 222/212 |
| 2004/0050881 | A1 * | 3/2004 | Deussen | B65D 47/18 222/420 |
| 2011/0125111 | A1 | 5/2011 | Chibret et al. | |
| 2011/0163114 | A1 * | 7/2011 | Webb | A61J 1/1443 222/1 |
| 2012/0305607 | A1 * | 12/2012 | Geiger | B65D 47/2025 222/494 |
| 2014/0151401 | A1 * | 6/2014 | Murphy | B65D 35/44 222/107 |

* cited by examiner

TUBE WITH THROTTLE INSERT

INCORPORATION BY REFERENCE

The following documents are incorporated herein by reference as if fully set forth: Swiss Patent Application No, 00585/16, filed May 3, 2016.

BACKGROUND

The invention relates to a tube having a throttle insert, to a throttle insert and to a method for producing a tube.

In numerous fields of use, it is necessary for liquids to be dispensed or dosed in dropwise fashion. This applies in particular to liquids with pharmaceutical or cosmetic active substances or for liquids with coloring agents, flavoring agents or aromatic substances, which are used for example in the processing of foodstuffs. The viscosity of such liquids preferably lies in the range from 1 to 100 MPa·s. The term "liquids" also refers to liquid mixtures and emulsions.

Suitable vessels for storing and dispensing such liquids are in particular tubes and small tube-like bottles. These comprise a reservoir, which contains the liquid to be dispensed, and a connector with a dispensing opening. The connector forms a dispensing duct, the distal end of which is connected to the reservoir and at the proximal end of which the dispensing opening is arranged. The expressions "proximal" and "distal" relate in each case to the position or direction relative to the dispensing opening. Various factors influence the size and/or the volume of droplets formed by the liquid at the dispensing opening before said droplets detach from the connector. Such factors are for example the interfacial tension or the surface tensions of the liquid to be dispensed and of the connector, the size and shape of the connector in the region of the dispensing opening, the pressure and the flow speed of the liquid in the dispensing duct, and the gravitational force acting on the emerging liquid.

In particular in the case of tubes or tube-like vessels whose reservoir is delimited by a deformable shell, a pressure force acting on the respective tube from the outside in addition to the ambient pressure gives rise to a pressure increase in the interior of the reservoir in relation to the ambient pressure. In this way, liquid is forced out of the reservoir through the dispensing duct to the dispensing opening, where said liquid emerges from the tube. With increasing pressure, the volume flow of the liquid discharged through the dispensing opening also increases. This dependency of the volume flow on the pressure force exerted on the tube by a person in addition to the ambient pressure prevents or hinders the formation of droplets of uniform size. Dosing of the liquid through the dispensing of droplets of uniform size is thereby impaired or even made impossible.

In the case of tubes whose shell is elastically deformable, wherein the shell may be manufactured for example from plastic or from a composite material with plastic, the elastic restoring force of the material in the absence of forces acting on the shell from the outside in addition to the ambient pressure has the effect that the pressure in the reservoir is lower than the ambient pressure. In the presence of an adequately large pressure difference, this has the effect that liquid situated in the dispensing duct is forced by the suction action back into the reservoir, wherein ambient air ingresses into the dispensing duct through the dispensing opening.

WO2013/075256A1 has disclosed a tube which comprises a dispensing duct in the form of an elongate connector. The distal end of the connector is connected via a tube shoulder to the tube shell. The connector is, on the outside and on the inside, of slightly conical form, wherein the inner diameter decreases from the distal end to the dispensing opening. Proceeding from the distal end of the connector, an insert is inserted into the connector such that an abutment element of the insert abuts against the inner side of the tube shoulder and thereby prevents the insert from ingressing further into the connector in the direction of the dispensing opening. The insert comprises a proximal section and a distal section, the shell surfaces of which bear in sealing fashion against the inner wall of the connector in said position. The two sections of the insert are connected to one another by a connecting neck of relatively small diameter, such that the inner side of the tubular connector and the insert delimit a ring-shaped intermediate space. The intermediate space is connected by in each case one longitudinal groove in the distal section and in the proximal section of the insert to the interior of the tube body and to that section of the dispensing duct which adjoins the dispensing opening. An additional recess in the abutment element ensures that the connection to the interior of the tube body is ensured. In this way, a throttle passage is formed which acts as a flow resistance and which limits the volume flow of the liquid to be dispensed even if the tube is compressed. It is thereby ensured that the formation of droplets at the dispensing opening is substantially independent of the pressure force exerted on the tube.

The insert comprises, axially adjoining the abutment element in the distal direction, a projection which can be utilized as an installation aid for the insertion of the insert into the connector. This projection is formed coaxially and mirror-symmetrically with respect to the front part of the insert, wherein the plane of symmetry lies in the region of the abutment element.

The projection protrudes into the tube body to a relatively great extent. When the flexible tube shell is compressed, said tube shell can come into contact with the projection and exert a force on the insert. This can cause a release of the force-fitting connection between the shell surfaces of the insert and the inner wall of the connector.

In the case of a tube as disclosed in WO2013/075256A1, the insert and the connector are of conical form and are precisely coordinated with one another in terms of shape and size. In a relative axial position defined by the abutment element and the tube shoulder, it is necessary for the shell surfaces of the insert to bear areally in sealing fashion against the inner wall of the connector with the exertion of a radial pressing force. This necessitates an adequately large length of the connector and of the insert in the axial direction. WO2013/075256A1 discloses that the connector is in the form of an elongate cannula and comprises a section with an external thread, which adjoins the tube shoulder, and a front section, which adjoins the former section and which has the dispensing opening. The insert extends in the axial direction beyond the section with the external thread into the front section. The diameter of the dispensing duct, even at the distal end of the connector, is small in relation to the length of the connector.

SUMMARY

It is an object of the present invention to provide a tube with a dispensing duct and with a throttle insert securely fastened in said dispensing duct, and to provide a throttle insert for a tube of said type. It is a further object of the invention to specify a method for fastening the throttle insert in the tube.

These objects are achieved by a tube, a throttle insert for a tube, and by a method for fastening a throttle insert in the dispensing duct of a tube according to one or more features of the invention.

The vessel, which is preferably in the form of a tube or tube-like bottle, comprises a reservoir for a fluid medium and comprises a connector with a dispensing duct which connects a dispensing opening to the reservoir. The dispensing opening is arranged at a front section of the connector, which is also referred to as proximal section. This proximal section may be designed differently in accordance with the respective requirements, and may for example comprise an elongate conical cannula, a ring-shaped body with a short tube section, or a disk with a central opening. Parameters such as shape, size, opening cross section, material or surface condition of the proximal section may be optimized in accordance with the liquid to be dispensed, such that the dispensing of droplets of a desired size or of a particular volume is promoted. In a distal section, the connector preferably comprises an external thread or generally an external holding structure for the screwing-on or fastening of a protective cap. The dispensing duct is, in said region, of at least approximately cylindrical or slightly conical form, wherein the inner diameter remains constant, or increases, axially in the distal direction. The distal end of the connector is connected by a tube shoulder to a tube shell which encloses the reservoir. A throttle insert formed substantially as a plug-like body of revolution is inserted into the distal section of the connector, whereby the free cross section of the dispensing duct is reduced in size. The throttle insert is preferably a dome-shaped or cowl-shaped injection-molded part. Such parts can be produced efficiently and can be easily inserted into the connector. Furthermore, the amount of material required for the production process is small in relation to a solid body.

In conjunction with the inner wall of the connector, the throttle insert forms a chicane or an obstruction for a liquid which is conveyed in the dispensing duct from the reservoir in the direction of the dispensing opening. In this way, the maximum volume flow of the liquid that is displaced from the reservoir to the dispensing opening in the presence of a certain positive pressure in the reservoir in relation to the ambient pressure can be limited or throttled. In this way, uniform droplet formation at the dispensing opening can be ensured at the dispensing opening. In the case of a tube or a bottle, it is thus possible to prevent an excessively large liquid flow from being pressed out of the dispensing opening, for example in the manner of a jet, if the tube shell is compressed with excessive intensity.

The throttle insert blocks the dispensing duct with the exception of one or more throttle ducts, which form a constriction in the dispensing duct.

The outer diameter of the throttle insert is at its greatest in the region of a lower or distal outer edge, where an outer shell surface and a face-side abutment ring of the throttle insert meet. This abutment ring undercuts a step which is formed in the distal section of the connector at the inner wall thereof. The step may in particular comprise a ring-shaped bead which projects on the inner wall of the connector, or at least one section of a ring-shaped bead of said type. Alternatively or in addition, it is also possible for the step to comprise a section of the boundary surface of a ring-shaped recess on the inner wall of the connector. Such a step may for example already be prefabricated during the production of the connector or of the tube part with the connector as an injection-molded part.

The step is however preferably formed for the first time as the throttle insert is pushed in, wherein the inner wall of the connector is plastically deformed by radially acting pressure forces with which the throttle insert acts on the connector, and said inner wall thereby adapts, at least in the region of the abutment ring, to the shape of the throttle insert. This effect is promoted if the material of the throttle insert is harder than that of the connector and does not plastically deform, or plastically deforms only to an insignificant extent, during the pressing-in process. For example, the insert may thus be manufactured from polypropylene, and the tube head may be manufactured from polyethylene, preferably HDPE.

The edge angle enclosed by the outer shell surface and the face-side abutment ring at the outer edge is preferably 90° or smaller, and the outer edge is of comparatively sharp-edged form. The penetration of said edge into the connector and the displacement of material of the connector during the pressing-in process are thereby promoted, such that the edge is easily wedged together with the connector and prevents the throttle insert from emerging again. At the outer edge, the abutment ring has a gradient angle which is greater than or equal to 0°. This permits a particular secure form-fitting connection of the throttle insert with the connector. Adjacent to the lower outer edge, the outer shell surface of the throttle element comprises a distal section, the gradient angle of which preferably substantially corresponds to the gradient angle of the inner wall of the connector at said location. In the case of a cylindrical inner wall, the gradient angle is thus at least approximately 90°. In addition to the form fit, it is thus possible for a force-fitting areal connection of the throttle insert with the connector to be realized.

It is preferable for one or more primary throttle ducts to be arranged along the periphery of the throttle insert, wherein each of said primary throttle ducts is delimited by a channel-like recess on the outer shell surface of the throttle insert and by the inner wall of the connector. Throttle inserts of this type can be produced comparatively easily and inexpensively in different variants. It is for example possible for the number, arrangement, shape and size of such throttle ducts to be modified with just a few simple modifications to the tool for the production of such injection-molded parts. The production of corresponding tools is likewise relatively simple and inexpensive. Even throttle ducts which form a constriction with a very small cross-sectional area can thus be produced easily. Due to the height of the distal section of the shell surface, the length of the primary throttle ducts can be predefined. A relatively long throttle duct forms a relatively large flow resistance for the liquid. Within a throttle duct, the flow resistance can be influenced further, for example by virtue of one or more steps changing the free cross-sectional area along the flow path.

The outer shell surface of the throttle insert preferably comprises, adjoining the distal section, a proximal section which decreases in size in continuous or step fashion as far as an upper or proximal outer edge, such that the inner wall of the connector and the outer shell surface of the throttle insert delimit a ring-shaped chamber into which the one or more primary throttle ducts open.

The throttle insert comprises, adjoining the proximal outer edge, a top section which completes the separation of the dispensing duct into a proximal region facing toward the outlet opening and a distal region facing toward the reservoir.

The throttle insert, or the top section thereof, may be arranged with an adequately large spacing to the proximal section of the connector such that the proximal section of the dispensing duct comprises no further constrictions between the ring-shaped chamber and the dispensing opening, and liquid can pass unhindered from the ring-shaped chamber to the dispensing opening.

The top section of the throttle insert comprises a central region of disk-like or pan-like form and comprises a peripherally arranged contact ring. The contact ring is a ring-shaped step which projects axially on the central region of the top section. The contact ring adjoins the proximal outer edge of the shell surface and comprises a face-side contact surface which, in the installed state of the throttle insert, preferably bears against the inner side of the proximal section of the connector. Analogously to the primary throttle ducts, one or more channels are recessed into the contact surface, which channels, together with the adjoining part of the connector, delimit one or more secondary throttle ducts. The top section delimits, together with the distal section of the connector, a dispensing chamber, the size or volume of which can be predefined by the design of the top section, in particular by the size of a pan-like structure formed in the top section. The volume thus defined may be used for example as an auxiliary aid for the dosing of a liquid quantity to be dispensed, wherein, firstly, by compression of the tube shell with the tube upright, the volume of the pan-like structure is filled with liquid and, subsequently, the liquid collected in the pan-like structure is dispensed through the dispensing opening in dropwise fashion by turning the tube, without pressure being exerted on the tube shell.

Analogously to the primary throttle ducts, the secondary throttle ducts may be utilized for further limitation of the volume flow of the liquid. Through the design of the throttle insert, it is thus possible for parameters which influence the dispensing of liquid to be influenced. In particular, it is for example possible for the number, length and cross section of the primary and secondary throttle ducts, and the sizes of the ring-shaped chamber and of the dispensing chamber, to be adapted in accordance with the liquid to be dispensed.

Throttle inserts can be easily produced with different heights and outer diameters and thus optimized for tubes with different dispensing connectors. If the form fit of the throttle insert with the dispensing connector is realized by virtue of said parts being pressed together radially, it is possible for tools that are used for producing tube parts with conventional dispensing connectors to also be utilized unchanged for producing corresponding parts for the tubes according to the invention. The connector of a tube is preferably manufactured as a unipartite molded part which also comprises the tube shoulder. The tube shell is for example manufactured from a laminate foil, which may comprise a barrier layer composed of metal or plastic, shaped to form a tube, and welded or connected in some other way to the tube shoulder.

In the case of automated production of the tube, the throttle insert can be easily gripped by a gripper and inserted from the distal side into the connector, where said throttle insert is pressed together radially with the connector in a predefined axial position. For this purpose, the throttle insert preferably comprises a cylindrical or slightly conical installation pin which projects axially on the distal side of the top section.

If this has not already been done in a preceding process step, the tube opening can now also be closed off by a removable protective cap.

Such prepared tubes may be sterilized before being filled with the liquid. The materials used are selected such that they can withstand the ambient conditions required for this, such as for example high temperatures, without sustaining damage.

After the filling with the respective liquid, the open distal end of the tube shell is closed off, for example by welding.

BRIEF DESCRIPTION OF THE DRAWINGS

The invention will be described in more detail below on the basis of a number of figures, in which.

DETAILED DESCRIPTION OF THE PREFERRED EMBODIMENTS

Figure 1:
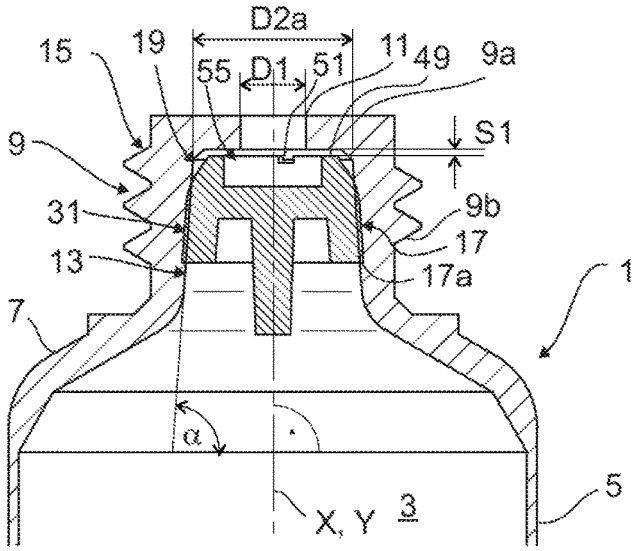
FIG. 1 shows a cross section through a first tube with a first throttle insert in the region of the dispensing opening.

FIG. 1 shows a first embodiment of a tube 1 with a reservoir 3 for a fluid or a liquid medium, wherein the reservoir 3 is encased or enclosed by a tube shell 5. The tube shell 5 is preferably manufactured from a multi-layer laminate foil, which comprises at least one plastics layer and preferably one barrier layer composed of metal or plastic and which is shaped to form a tube. Via a tube shoulder 7, a front edge of the tube shell 5 is connected to a distal section 9*b* of a tubular connector 9, which forms a dispensing duct 13. At a proximal section 9*a* of the connector 9 there is formed a dispensing opening 11 which is connected via the dispensing duct 13 to the reservoir 3. The connector 9 and the tube shoulder 7 may be manufactured as a single injection-molded part, which, with the exception of an external thread 15 in the distal section 9*b* of the connector 9, is substantially rotationally symmetrical with respect to a tube axis X. In the embodiment as per FIG. 1, the proximal section 9*a* of the connector 9 is a ring-shaped disk, the central recess of which is the dispensing opening 11. The diameter D1 of the dispensing opening 11 is smaller than the smallest inner diameter D2*a* of the dispensing duct 13 in the adjoining distal section 9*b* of the connector 9. The ring-shaped disk thus forms an abutment surface which projects radially inwardly on the inner wall of the connector 9.

This inner wall has an angle of inclination $\alpha$, which may lie for example in the range from 75° to 90°, with respect to a plane normal to the tube axis X.

Figure 2:
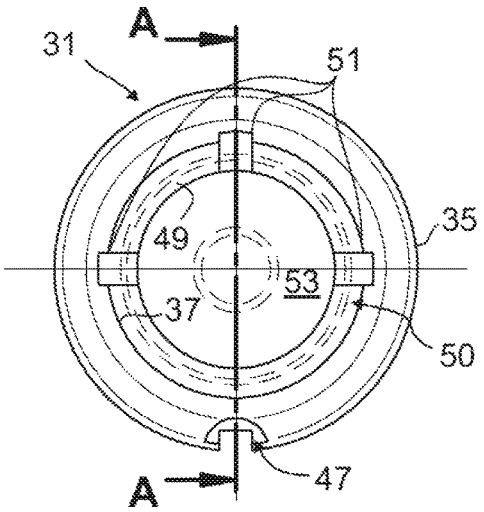
FIG. 2 shows a plan view of the first throttle insert.
Figure 3:
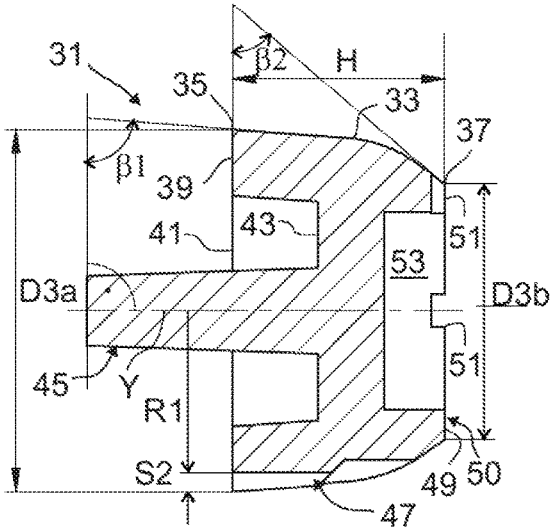
FIG. 3 shows a cross section through the throttle insert along the line A-A in FIG. 2.
Figure 4:
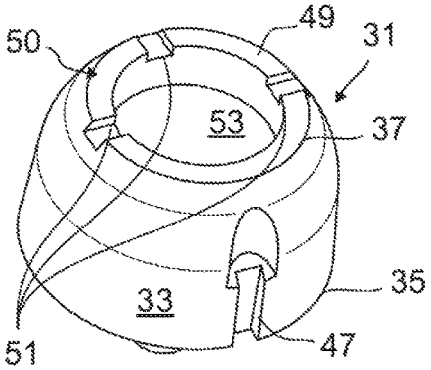
FIG. 4 shows a perspective view of the first throttle insert.
Figure 5:
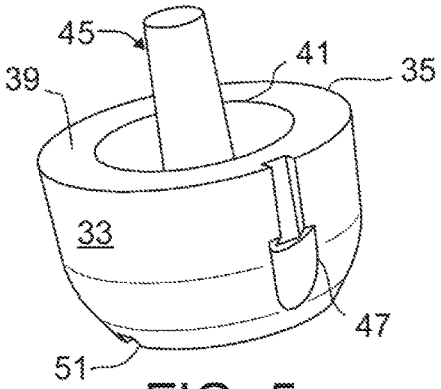
FIG. 5 shows a further perspective view of the first throttle insert.

A throttle insert 31, which is illustrated in more detail in FIGS. 2 to 4, is inserted into the dispensing duct 13 so as to have a small spacing S1 with respect to the ring-shaped disk or with respect to the abutment surface of the proximal section 9*a* of the connector 9, wherein said spacing S1 preferably lies in the range from 0 to 1 mm. The throttle insert 31 comprises substantially a dome-like or cowl-like body of revolution with an outer shell surface 33 which extends from a lower or distal outer edge 35 with a maximum diameter D3*a* over a height H to an upper or proximal outer edge 37 with a diameter D3*b*, wherein D3*b* is smaller than D3*a*. With respect to a plane normal to the axis Y of the throttle insert 31, the shell surface 33 has, at the distal outer edge 35, an angle of inclination ß1 and, at the proximal outer edge 37, an angle of inclination ß2, wherein ß1>=ß2. In between, the gradient angle of the shell surface 33 may vary in continuous or stepped fashion. Alternatively or in addition, it would also be possible for the outer diameter of the shell surface 33 to decrease in one or more steps along the height H. The outer diameter of the throttle insert 31 is smaller adjacent to the proximal outer edge 37 than at the distal outer edge 35.

It is preferably the case that the angle of inclination ß1 and the outer diameter D3 at the distal outer edge 35 and in a distal section 9*b*, adjoining said distal outer edge, of the throttle insert 31 correspond to the angle of inclination α and the inner diameter D2 of the adjoining distal section 9*b* of the connector 9.

This is the case in particular if a throttle insert 31 is pressed together radially with the connector 9. During the pressing-in of the throttle insert 31, the inner wall of the connector 9 is plastically deformed and, in the distal section 9*b*, is adapted to the outer contour of the throttle insert 31. In this way, a ring-shaped step 17*a* is also formed on the inner wall of the connector 9, the outer diameter of which ring-shaped step corresponds to the maximum outer diameter D3*a* of the throttle insert 31. This ring-shaped step 17*a* may be relatively narrow, and preferably has a width which lies in the range from 0.1 mm to 0.6 mm, in particular from 0.1 mm to 0.2 mm. The ring-shaped step 17*a* is the lowermost section, or a distal end section, of a ring-shaped recess 17 which is caused by the distal section 9*b* of the throttle insert 31 during the pressing-in into the cylindrical or conical inner wall of the connector 9. During the pressing-in of the throttle insert 31 into the dispensing duct 13, said throttle insert, due to the relatively large outer diameter D3*a*, causes an expansion of the wall of the connector 9 and partially contracts again behind the distal outer edge 35.

At the distal outer edge 35, the throttle insert 31 comprises a face-side abutment ring 39 which adjoins the shell surface 33 and which preferably lies in a plane orthogonal to the axis Y of the throttle insert 31, or which may alternatively have an angle of inclination between 0° and approximately 60° (not illustrated). In the direction of the axis Y, radially adjacent to the inner edge of the abutment ring 39, a ring-shaped cavity 41 is recessed out of the body of the throttle insert 31. This gives rise to a material saving and a more uniform material thickness in relation to a solid body, which is advantageous for the efficient production of an injection-molded part. This is of importance in particular for the production of throttle inserts with relatively large outer diameters. Furthermore, for the pressing-in of the throttle insert 31 into the connector 9, a tool or a plunger can be inserted into the cavity 41, which tool bears against the inner wall of the throttle insert 31 and promotes the radial pressing-in of the throttle insert 31 into the inner wall of the connector 9.

A preferably cylindrical or slightly conical axial installation pin 45 projects in a distal direction on a base disk 43 which delimits the cavity 41 as a face side, said installation pin projecting preferably beyond the plane of the distal outer edge 35.

Along the periphery of the throttle insert 31, a channel-like primary throttle duct 47 is recessed into the shell surface 33, the distal end of which primary throttle duct opens out in the face-side abutment ring 39, and the proximal end of which primary throttle duct opens out in the proximal section of the shell surface 33, where the outer diameter D3 of the shell surface 33 is relatively small for the purposes of delimiting the ring-shaped chamber 19. The depth S2 of the primary throttle duct 47 and the radius R1 of the throttle insert 31 in the region of the primary throttle duct 47 are dimensioned such that, when the throttle insert 31 is inserted into the connector 9, a passage opening for the passage of liquid out of the reservoir 3 into the ring-shaped chamber 19 remains free at both ends of the primary throttle duct 47. The cross section of said passage openings may be optimized in accordance with the liquid to be dispensed and the respective design of the connector 9. Since at least the distal region of connectors 9 of various tubes is standardized, it is possible for a multiplicity of different tubes to be equipped with relatively few embodiments of the throttle insert 31. Since the throttle insert 31 is inserted, in the interior of the connector 9, into the dispensing duct 13, it is also possible in the case of such tubes to use standardized closures. At the proximal outer edge 31, a face-side top section 50 of the throttle insert 31 adjoins, by a peripheral contact ring 49, the shell surface 33. The central region of the top section 50 is of disk-like form or is in the form of a pan-like depression 53. Analogously to the primary ducts 47, one or more channels are recessed out of the contact ring 49, which channels are provided for delimiting, together with the adjoining part of the connector 9, one or more secondary throttle ducts 51 when the contact ring 49, in the proximal section 9*a*, bears against the inner side of the connector 9 or is in contact with said inner side. The ends of said secondary throttle ducts 51 open into the ring-shaped chamber 19 and into a dispensing chamber 55 which is connected to the dispensing opening 11 and which is delimited by the proximal section 9*a* of the connector 9 and by the top section 50 of the throttle insert 31. If the top section 50 has a depression 53 adjoining the contact ring 49, said depression can be used for the dosing of a certain quantity of the liquid to be dispensed. With the tube 1 held upright, it is firstly the case that, by virtue of the reservoir 3 being compressed, liquid is conveyed into the pan-like structure 53 until the latter is full. If the liquid level rises above the edge of the contact ring 49, the excess liquid can be sucked back into the reservoir 3 by a negative pressure in the reservoir 3 caused by the elastic restoring force of the tube shell 5.

As shown in FIG. 1, the throttle insert 31 can be arranged axially in the connector 9 so as not to bear directly against the proximal section 9*a* of the connector 9, such that a ring-shaped gap remains free between the contact ring 49 and the proximal section 9*a* of the connector 9. This gap connects the ring-shaped chamber 19, additionally or alternatively to the secondary throttle ducts 51, to the dispensing chamber 55. By the gap width S1 and the cross-sectional area of the one or more secondary throttle ducts 51, the flow resistance exerted by the throttle insert 31 on a particular liquid when the latter is displaced out of the reservoir 3 toward the dispensing opening 11 can be additionally influenced.

Figure 6:
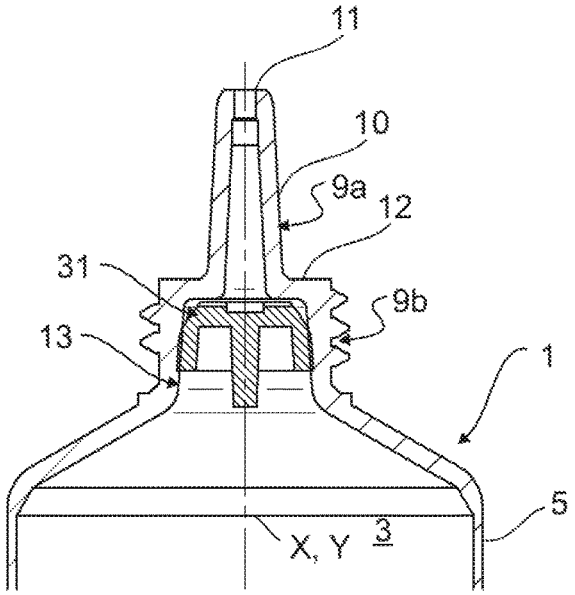
FIG. 6 shows a cross section through a second tube with a second throttle insert in the region of the dispensing opening.
Figure 7:
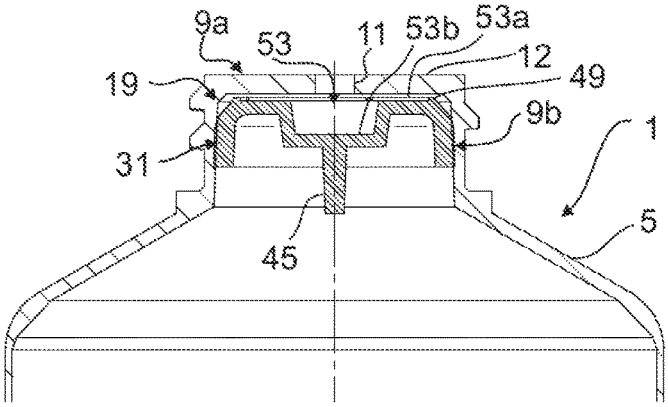
FIG. 7 shows a cross section through a third tube with a third throttle insert in the region of the dispensing opening.
Figure 8:
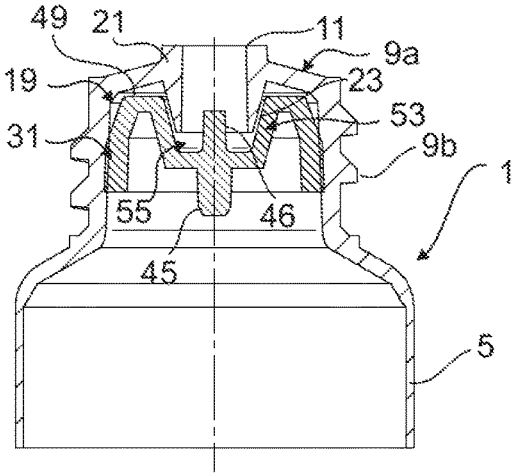
FIG. 8 shows a cross section through a fourth tube with a fourth throttle insert in the region of the dispensing opening.

In an embodiment of the tube 1 as per FIG. 1, the external thread 15 is an M9×1.5 thread. The corresponding throttle insert 31 has a maximum outer diameter D3*a* of 5.5 mm and a height H of 3.2 mm. The number of primary throttle ducts 47 is 1, and the number of secondary throttle ducts 51 is 3, wherein all of the throttle ducts 47, 51 are arranged in uniformly distributed fashion, at angular intervals of 90°, on the throttle insert 31. The invention also encompasses other embodiments of the tube 1 and/or of the throttle insert 31, in which, in particular, the number, arrangement, cross sections and design of the primary throttle ducts 47 and/or of the secondary throttle ducts 51 may differ. It is preferably the case that primary throttle ducts 47 and secondary throttle ducts 51 are arranged offset with respect to one another. This promotes a further increase of the flow resistance. FIGS. 6, 7 and 8 show further embodiments of tubes 1 with throttle inserts 31.

In the case of a tube 1 as per FIG. 6, the proximal section 9*a* of the connector 9 comprises a slightly conical cannula 10, at the relatively narrow end of which the dispensing opening 11 is arranged, and the relatively wide end of which is connected by means of a ring-shaped flange 12 to the distal section 9*b* of the connector 9. In the embodiment of the tube 1 illustrated in FIG. 6, the external thread 15 is an M11×1.5 thread. The throttle insert 31 has a maximum outer diameter D3*a* of 7.2 mm and a height H of 3.6 mm. In relation to the embodiment of the throttle insert 31 as per FIG. 3, the contact ring 49 is wider. The diameter of the pan-like structure 53 is relatively small, and the secondary throttle ducts 51 extend radially toward the tube axis X beyond the inner edge of the ring-shaped flange 12, such that the ends that open into the dispensing chamber 55 are no longer covered by the ring-shaped flange 12.

The further tube 1 illustrated in FIG. 7 comprises an M22×1.5 external thread 15. The throttle insert 31 has a maximum outer diameter D3*a* of 18.3 mm and a height H of 5.3 mm. In comparison with the embodiment of the throttle insert 31 as per FIG. 3, the outer diameter D3*a* is considerably larger in relation to the height H. The contact ring 49 is a relatively narrow ring, the width and height of which may for example lie between 0 and 1 mm. The secondary throttle ducts 51 are correspondingly short. The pan-like structure 53 in the top section 50 comprises, adjoining the contact ring 49, an outer ring 53*a* or a first ring-shaped step which lies substantially at the base level of the contact ring 49. The outer ring 53*a* is a flange-like edge of an inner pan-like structure 53*b*, the base of which lies at a considerably lower level between those of the distal outer edge 35 and of the outer ring 53*a*. The inner edge of the outer ring 53*a* has a larger radius than the dispensing opening 11, such that the outer ring 53 is completely covered by the proximal section 9*a* of the connector 9.

In the case of the further tube 1 illustrated in FIG. 8, the proximal section 9*a* of the connector 9 is in the form of a ring-shaped collar adjoining the distal section 9*b*, the inner edge of which collar is a tube section 21 whose proximal end defines the dispensing opening 11.

The shape and size of the throttle insert 31 is coordinated with the design of the connector 9 such that the distal end region of the tube section 21 protrudes into the pan-like structure 53 or axially overlaps the edge of the pan-like structure 53 such that the inner wall of the pan-like structure 53 and the end region of the tube section 21 form a ring-shaped gap 23 which connects the ring-shaped chamber 19 to the dispensing chamber 55. The tube section 21 may be beveled at the outside, as illustrated in FIG. 8. The wall of the pan-like structure is correspondingly inclined. Alternatively or in addition to one or more secondary throttle ducts 51 arranged at a face side on the contact ring 49, these throttle ducts may also be arranged analogously on the inner wall of the pan-like structure 53. This has the advantage that, even when the inner wall of the pan-like structure 53 bears against the tube section 21, at least the free cross-sectional area of the secondary throttle ducts 51 remains free for the passage of liquid.

Coaxially with respect to the installation pin 45, a droplet pin 46 projects, on the inner side of the pan-like structure 53, into the distal end of the tube section 21. The formation of droplets of the liquid to be dispensed can be influenced by means of characteristics of the tube section 21 and of the throttle insert 31, in particular also of the droplet pin 46. Aside from geometrical characteristics, it is the case in particular that surface characteristics such as roughness and surface tension have a major influence on the nature of the droplet formation.

The invention claimed is:

1. A throttle insert (31) for use in a tube (1), comprising: a dome-shaped body of revolution with an outer shell surface (33) and with an abutment ring (39), the shell surface (33) extends from a distal outer edge (35) with a maximum diameter (D3*a*) to a proximal outer edge (37) with a relatively smaller outer diameter (D3*b*), the abutment ring (39) adjoins the distal outer edge (35) at a face side, a channel-shaped recess as a delimitation for a primary throttle duct (47) is recessed in the shell surface (33), and said channel-shaped recess extends from a mouth in the abutment ring (39) to a mouth in the shell surface (33).

2. The throttle insert (31) according to claim 1, wherein the body of revolution has, adjoining an inner edge of the abutment ring (39), a ring-shaped cavity (41) which is delimited at a face side by a base plate (43) and at an inside by an installation pin (45) which projects in a distal direction from the base plate (43).

3. The throttle insert (31) according to claim 1, wherein the body of revolution comprises a face-side top section (50) with a peripheral contact ring (49) adjoining the proximal outer edge (37), the top section (50) is disk-shaped or has a pan-shaped depression (53), and at least one channel as a delimitation of a secondary throttle duct (51) is recessed in the contact ring (49).

4. A tube (1), comprising a reservoir (3) for a fluid medium, a connector (9) with a dispensing duct (13) which connects a dispensing opening (11) to the reservoir (3), the dispensing opening (11) is arranged at a proximal section (9*a*) of the connector (9), and a distal section (9*b*) of the connector (9) is connected via a tube shoulder to a tube shell (5) which encloses the reservoir (3), a throttle insert (31) arranged in the dispensing opening (13) so as to form in the dispensing opening (13) a constriction which closes off the dispensing opening (13) aside from at least one primary throttle duct (47) in the throttle insert, the throttle insert (31) is dome-shaped and includes an outer shell surface (33) and a face-side abutment ring (39) that meet at a distal outer edge (35), and the throttle insert (31) is fastened with a form-fit in the connector (9) by the face-side abutment ring (39) which forms an undercut with a ring-shaped step (17*a*) on an inner wall of the connector (9).

5. The tube (1) according to claim 1, wherein the ring-shaped step (17*a*) is a distal end section of a ring-shaped recess (17) on the inner wall of the connector (9).

6. The tube (1) according to claim 1, wherein the connector (9) and the throttle insert (31) are manufactured from different plastics, and a material of the throttle insert (31) is harder than a material of the connector (9).

7. The tube (1) according to claim 1, wherein the outer shell surface (33) of the throttle insert (31) extends from the distal outer edge (35) to a proximal outer edge (37), and a diameter (D3*a*) at the distal outer edge (35) is greater than a diameter (D3*b*) at the proximal outer edge (37), a distal section, adjoining the distal outer edge (35) of the throttle insert (31), of the shell surface (33) bears in sealing fashion against the inner wall of the connector (9), and a proximal section, adjoining the proximal outer edge (37), of the shell surface (33) is arranged radially spaced apart from the inner wall of the connector (9), such that said inner wall and the proximal section of the shell surface (33) delimit an interposed ring-shaped chamber (19).

8. A method for producing a tube (1) according to claim 1, comprising pushing the throttle insert (31) into the interior of the connector (9) from the distal side as far as a certain axial position and pressing the throttle insert together radially with the connector (9), and plastically deforming a material of the connector (9) adjacent to the throttle insert (31), creating an axial undercut of the connector (9) by the throttle insert (31).

9. The tube (1) according to claim 1, characterized in that the primary throttle duct (47) is delimited by a channel-shaped recess on the outer shell surface (33) of the throttle insert (31) and by the inner wall of the connector (9), and the primary throttle duct (47) has a first mouth at the face-side abutment ring (39) and has a second mouth in the shell surface (33).

10. The tube (1) according to claim 9, wherein the throttle insert (31) comprises a face-side top section (50) with a central region and with a peripheral contact ring (49) projecting axially thereon, and, for the connection of the ring-shaped chamber (19) to a dispensing chamber (55) which is connected to the dispensing opening (11), at least one of:

a) the contact ring (49) is arranged with a spacing (S1) to an adjacent abutment surface of the proximal section (9*a*) of the connector (9), or b) the contact ring (49) comprises at least one secondary throttle duct (51).

* * * * *